United States Patent [19]

Sofer

[11] 4,270,304

[45] Jun. 2, 1981

[54] FLUSH-FITTING TOY BUILDING BLOCKS

[76] Inventor: Nancy C. Sofer, P.O. Box 6764, Jerusalem, Israel

[21] Appl. No.: 961,667

[22] Filed: Nov. 17, 1978

[30] Foreign Application Priority Data

Dec. 2, 1977 [IL] Israel ..... 53519

[51] Int. Cl.[3] ..... A63H 33/06; A63H 33/08

[52] U.S. Cl. ..... 46/28; 46/20

[58] Field of Search ..... 46/19, 20, 23, 24–26, 46/27–29, 16, 17

[56] References Cited

U.S. PATENT DOCUMENTS

| | | | |
|---|---|---|---|
| 1,402,438 | 1/1922 | Nichols | 46/20 |
| 2,059,598 | 11/1936 | Pawlson | 46/20 |
| 2,110,990 | 3/1938 | Forbes | 46/20 |
| 2,712,199 | 7/1955 | Latimer | 46/28 |
| 3,007,279 | 11/1961 | Korchak | 46/28 |
| 3,748,778 | 7/1973 | Ellies et al. | 46/28 |
| 3,882,630 | 5/1975 | Bianco | 46/28 |
| 4,039,132 | 8/1977 | Fournier | 46/28 |

*Primary Examiner*—Gene Mancene
*Assistant Examiner*—Michael J. Foycik, Jr.
*Attorney, Agent, or Firm*—McAulay, Fields, Fisher, Goldstein & Nissen

[57] ABSTRACT

There is provided a toy building set facilitating the construction of integral plane horizontal and stepped surfaces in vertical building structures. The set is formed from a number of elements each having a rectangular cross section along at least a portion of their length wherein the elements each have a width of x, a height of substantially 2x and at least two notches cut into the height of the element along its length. The two notches being positioned adjacent the respective ends of the element and each having a length substantially equal to x and a height of m(x/2) wherein with regard to each individual element, m is the same and equal to 1 or 3 and wherein the length of the elements as measured between the center-lines of the two notches is substantially equal to p times x wherein x is a whole number or fraction thereof and p is a whole number.

11 Claims, 9 Drawing Figures

FLUSH-FITTING TOY BUILDING BLOCKS

The present invention relates to toy building sets comprising a plurality of building elements and to constructional elements for such sets.

A multitude of various types of toy building sets are known in the art and among the most popular of the known building sets are LEGO ® as described in Israel Pat. No. 12 091 and the Arthur Fisher series of building components of the type described in Israel Pat. No. 24393.

Despite the existence of so many types of building sets the toy industry is constantly searching in this crowded field for further new and different sets based on constructional elements having building potential different from or similar to that of known sets.

As early as 1922 there was known in the art, toy building bars for building model buildings which bars had oppositely grooved surfaces near their ends, the grooved portion of one bar being adapted to interlock with the grooved portion of contiguous bars extending at right angles thereto as described in U.S. Pat. No. 1,402,438 to form vertical building structures.

The building bars of said patent were substantially square in cross-section as were the basic logs described in U.S. Pat. No. 2,059,598 which constituted a later development of said type of "log cabin" construction although in U.S. Pat. No. 2,110,990 there were already mentioned so called log cabin style construction elements of oblong or circular cross-section.

All of said patents relating to log-cabin type construction, however suffered from the major drawback of providing very limited building possibilities of substantially vertical walled structures with various modifications to enable completion of gabled roofs.

In the last several decades no improvements have been suggested or made in said log-cabin style construction and in fact it is believed that the only building set marketed today employing the principles of said log-cabin construction is a constructional set called Lincoln Logs ® marketed by Milton Bradly Company comprising notched elements of substantially circular cross-section adapted to be attached one to another by means of interengagement of said notches with the lengths of the elements substantially at right angles to each other, the notched elements of said set being of substantially circular cross-section to simulate the effect of natural logs and thus not being attachable to each other except by interengagement of the rectangular notches cut therein. It has been noted however that the roundness of the logs of said present day set tends to make the log chain structures erected therewith somewhat unstable and easily collapsed to the great disappointment of children working therewith.

According to the present invention there is now provided a toy building set and elements therefor which are based on the log-cabin style construction however which are especially adapted to facilitate the construction of plane horizontal and stepped surfaces integrally engaged with vertical surfaces.

More specifically the present invention provides a toy building set especially adapted to facilitate the construction of integral plane horizontal and stepped surfaces in vertical building structures comprising a plurality of elements having a rectangular cross section along at least a portion of their length wherein said elements each have a width of x a height of substantially 2x and at least two notches cut into the height of the element along its length said notches being positioned adjacent the respective ends of said element and each having a length substantially equal to x and a height of m(x/2) wherein with regard to each individual element m is the same and equal to 1 or 3 and wherein the length of the elements as measured between the centerlines of said two notches is substantially equal to p times x wherein x is a whole number or fraction thereof and p is a whole number.

In contradistinction to the log pieces of said prior art sets, the elements of the present invention are inherently designed to build sturdy structures having integral plane horizontal vertical and stepped surfaces and are adapted for multiple and varied interengagement between elements as described hereinafter and in a manner neither taught, suggested nor possible with said prior art sets.

Thus the present invention provides a set of building elements wherein the particular interrelationship between the dimensions of the preferred building elements and the dimensions of the specific notches with which said elements can be provided and which essentially characterize preferred elements of the present invention result in distinct constructional advantages.

It is to be noted that while in U.S. Pat. No. 2,110,990 the possibility of blocks oblong in section is mentioned along with the possibility of logs of circular cross-section said patent neither teaches nor suggests the creation of a set based on a specifically chosen and critical height to width ratio of substantially 2 to 1 and the advantageous arrangements possible therewith as now discovered and described hereinafter. Furthermore none of said patents teaches or suggests the critical relationship and interrelationship between the width and height of the elements and the length of the elements as measured between the centerlines of said two notches and the enhanced building possibilities created by establishing such a relationship.

As stated and as will be explained in greater detail hereinafter in the elements of the building set of the present invention the lengths of said elements as measured between the centerlines of said two notches are substantially equal to p times x wherein x is as defined and p is any whole number.

In one aspect of the present invention there are provided building elements for a toy building set as defined above which elements each have two opposed side notches cut into the length of said element along its height wherein the height of each of said side notches is substantially equal to x and the length of said notch is substantially equal to x and wherein said element is further provided with at least two additional deep notches cut into the height of said element along its length wherein the height of said additional deep notches are 3x/2 the length of said notches is substantially equal to x and the length of the element is as defined hereinbefore wherein p is an even integer.

Especially preferred for use in the set according to the present invention are building elements which elements each comprise at least two end-notches cut into the height of the element along its length and adjacent the respective ends of said element wherein said notches each has a height of x/2 and wherein the length of said elements as measured between the centerlines of said end notches is substantially equal to (0x)p+x wherein x is as defined, 0 is an even integer and p is a whole number.

Thus in a preferred embodiment of the present invention there are provided building elements for a toy building set as defined above which elements each comprise two sets of opposed end notches cut into the height of said element along its length and adjacent the respective ends of said element wherein said notches each has a height of x/2 and wherein the neck of one element formed between sets of opposed end notches is adapted to engage a notch of another element alternatively either with the height of said neck spanning the length of the notch of said other element or with the width of said neck spanning the length of the notch of said other element.

In yet another preferred embodiment of the present invention there are provided building elements for a toy building set, as defined above, which elements are especially adapted for building stepped surfaces and are characterized by having two end notches cut into the height of the element along the bottom side of its length and adjacent the respective ends of said element, which notches have a length of x and a height of x/2, and two inset notches cut into the height of the element along the top side of its length at a distance closer to each other than the distance between the end notches which inset notches also have a length of x and a height of x/2 and wherein the length of the element as measured from the centerline of an end notch to the centerline of the inset notch closest to said end notch is substantially equal to x times q wherein x is as defined and q is an odd integer and preferably 1 or 3.

In order that these and other features and embodiments of the present invention may be more fully understood reference should be had to the following illustrative description read in conjunction with the accompanying drawings in which.

With specific reference now to the figures in detail it is stressed that the particulars shown and described are by way of example and for purposes of illustrative discussion only and are presented in the cause of providing what is believed to be the most useful and readily understood description of the principles and conceptual aspects of the invention. In this regard no attempt is made to show structural details of the set and its constituents in more detail than is necessary for a fundamental understanding of the invention, the description taken with the drawings and the subsequent examples and description making apparent to those skilled in the art how the several forms of the invention may be embodied in practice.

Referring first generally to FIGS. 1–6 there are respectively shown building elements 2–12 of the present invention, all of which elements are characterized by a rectangular cross-section along at least a portion of their length wherein said elements each have a width of x a height of substantially 2x and at least two notches 34 or 36 cut into the height of the elements along their lengths, said two notches being positioned adjacent the respective ends of said elements and each having a length substantially equal to x and a height of m(x/2) wherein with regard to each individual element m is the same and equal to 1 or 3 and wherein the length of the elements as measured between the centerlines of said two notches is substantially equal to p times x wherein x is a whole number or fraction thereof and p is a whole number.

Figure 4:
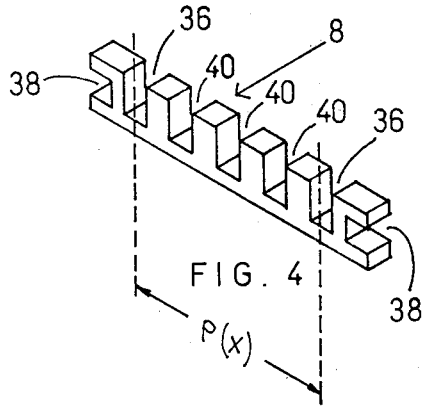

As will be noted and described in greater detail hereinafter each of elements 2, 4, 6, 10 and 12 comprise at least two end notches 34 cut into the height of the element along its length as shown wherein said notches each has a height of x/2 while the specialized element 8 illustrated in FIG. 4 is characterized by having two opposed side notches 38 cut into the length of said element along its height wherein the height of said side notch is substantially equal to x and the length of said notch is substantially equal to x and wherein said element is further provided with at least two deep end notches 36 cut into the height of said element along its length and adjacent the respective ends of said element wherein the height of said deep end notches are 3x/2. The length of said notches is substantially equal to x and the length of the element as measured between the centerlines of said two deep notches 36, when the element contains only said two deep notches 36 cut in its length (shorter element not shown) as well as the length of the element as measured between the centerlines of two adjacent additional deep notches 40 and between deep notches 36 and 40 are all substantially equal to 2x.

Having generally described the main characterizing features of the elements of the set according to the present invention the elements will now be individually described with reference to their structure and function as illustrated in the accompanying drawings.

Figure 1:
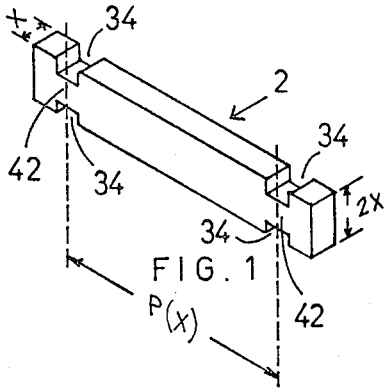
FIGS. 1–6 are isometric views of different building elements according to the present invention.

Referring first to FIG. 1 there is illustrated element 2 which is the basic building component of the set of the present invention. As illustrated with brief reference to FIG. 7 said basic elements are made to different lengths 2, 102, 202 and are adapted to enable the user to create planes of various dimensions. In most cases each such plane will be perpendicular to each adjacent plane and will have a vertical orientation for walls or a horizontal orientation for floor and other horizontal surfaces.

Figure 7:
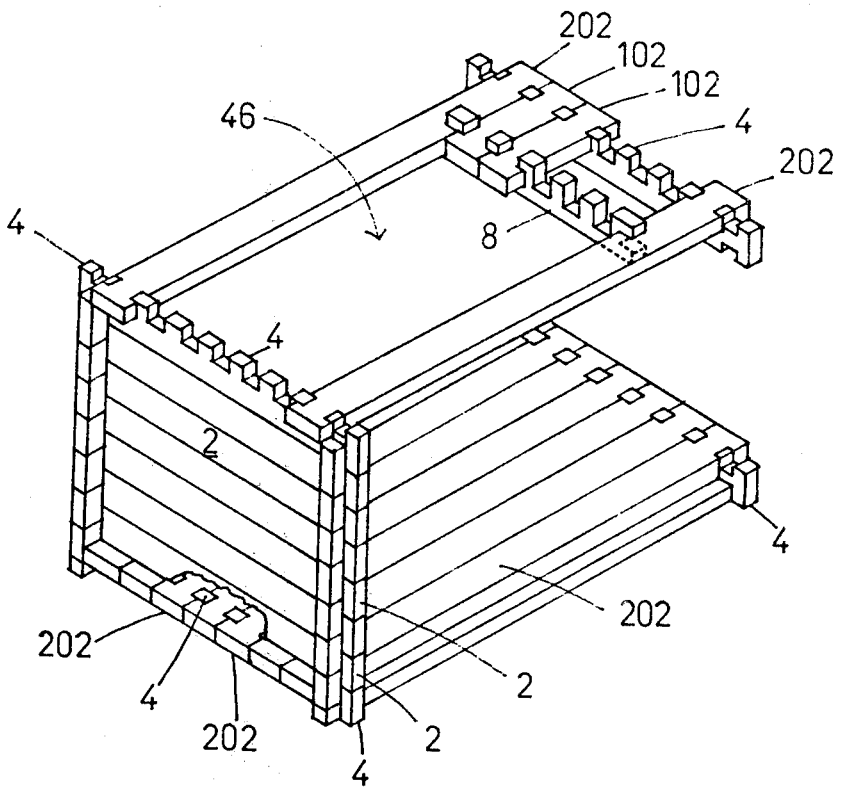
FIG. 7 is an isometric view showing the interengagement of various building elements according to the present invention in a partial structure in which the right hand side vertical wall as well as the back and front vertical walls have been omitted for purposes of clarity.

Said basic elements each comprise two sets of opposed end notches 34 cut into the height of said element along its length and adjacent the respective ends of said element wherein said notches each has a height of x/2 and wherein the neck 42 of one element formed between sets of opposed end notches 34 is adapted to engage a notch of another element both with the height of said neck spanning the length of the notch of said other element and with the width of said neck spanning the length of the notch of said other element as shown in FIG. 7.

Figure 2:
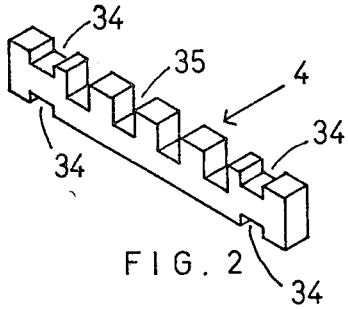

In FIG. 2 there is illustrated a unique building element 4 according to the present invention which piece, as shown especially with reference to FIG. 7, is adapted to be incorporated into a vertical wall (usually one made mostly of basic elements 2) in order to accommodate the connecting of a horizontal plane of basic elements, e.g., elements 202 whose height has been laid horizontally. Afterwards, the builder may go on adding to the height of said vertical wall, uninterrupted. Thus said piece is especially adapted to act in concert with specially designed basic elements 2, 202 etc. to facilitate the construction of plane horizontal surfaces such as floors, integrally engaged with vertical surfaces such as walls.

Said element 4 which also can be provided in different lengths each comprise two sets of opposed end notches cut into the height of said element along its length and adjacent the respective ends of said element wherein said notches each has a height of x/2 and at least one intermediate notch 35 positioned between a pair of end notches which intermediate notch 35 is characterized by a height, length and width all substantially equal to x. Preferably the length of the element as measured between the inner walls of said end notches is (2x)p wherein x is as defined and p is any whole number and the length of said elements is varied by the addition of extra intermediate notches 35 as defined. As will be noted the distance between the centerline of notch 34 and adjacent notch 35 is 3x/2.

Figure 3:
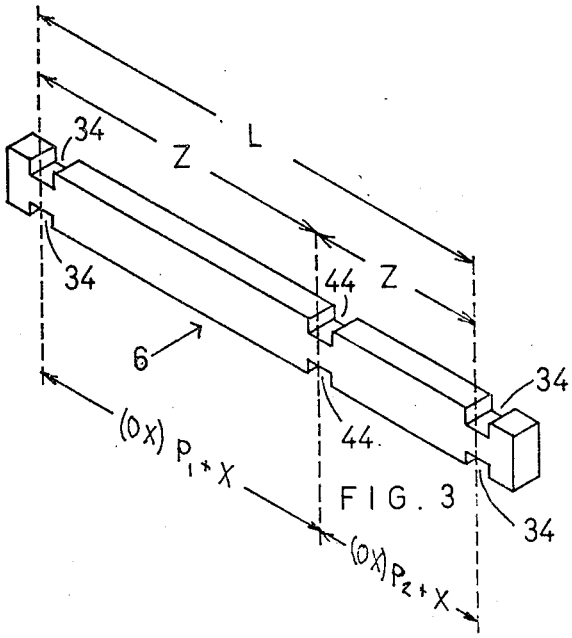
Figure 8:
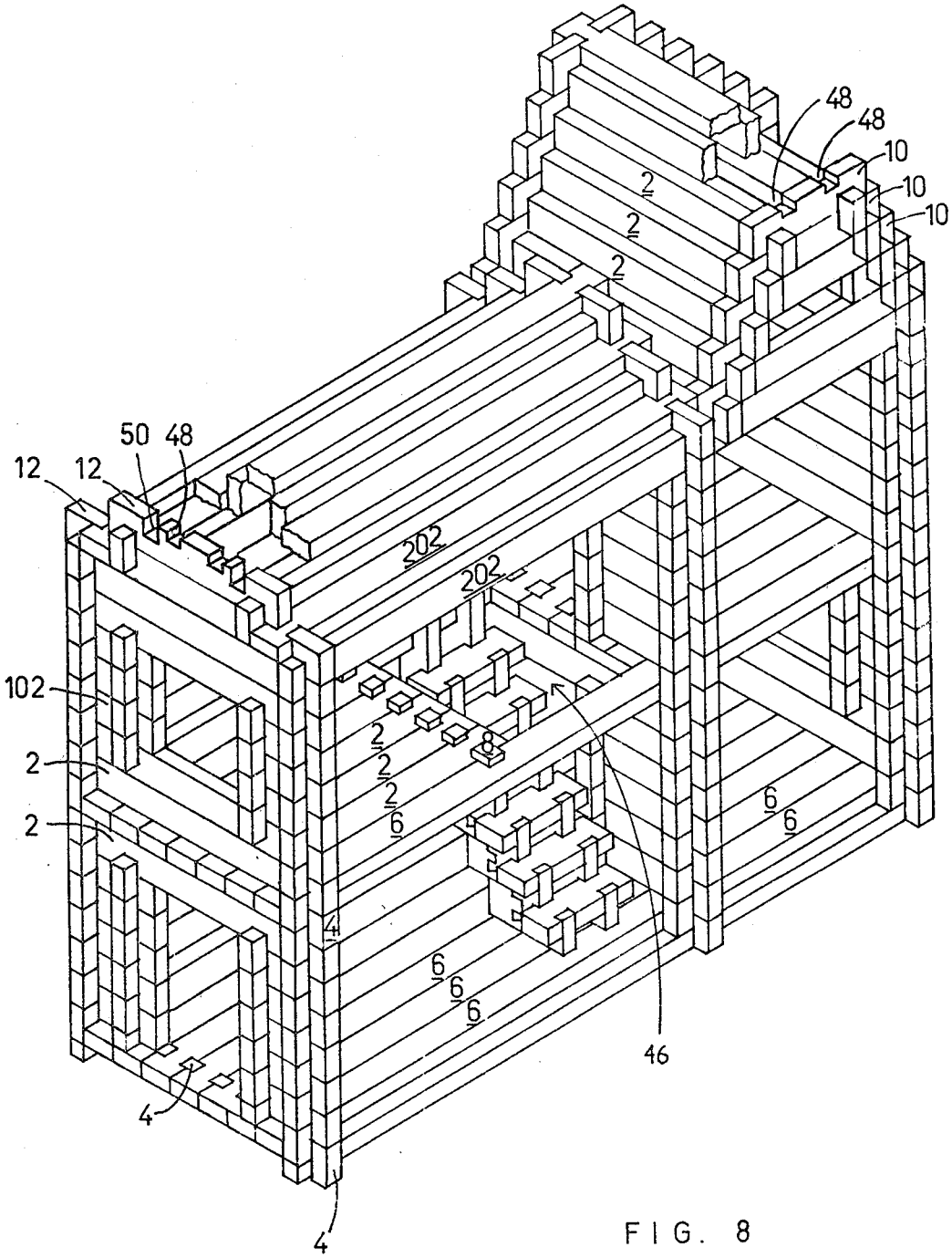
FIGS. 8 and 9 are isometric views of house-like structures built with elements according to the present invention.

While basic elements 2 of the present invention are adapted to receive perpendicular planes at their two ends only, in FIG. 3 there is illustrated special element 6 adapted to allow the creation of one or more additional intermediate perpendicular planes, such as inner walls in a house, as shown, e.g., in FIG. 8.

Said elements 6 each have a height of 2x, two sets of opposed end notches 34 cut into the height of said element along its length and adjacent the respective ends of said element and at least one pair of additional notches 44 cut into the height of said element along its length wherein all of said notches 34 and 44 have a height of x/2 and wherein the length of the element as measured between the center lines of two aligned end notches is substantially equal to $(2x)p+(y+1)x$ wherein y is the number of pairs of opposed additional notches 44, and p and x are as defined above.

With specific reference to elements 6 as shown in FIG. 3 and with reference to other elements of the present invention which elements each comprise at least two notches cut into the height of the element along its length and adjacent the respective ends of said element and contain at least one further notch cut into the height of said element along its length in the preferred embodiments of the present invention the notches of each of said elements are arranged symmetrically with reference to one or more axis extending parallelly to the height of the element. Furthermore said elements each have a sectional length Z as measured between the centerline of a pair of outermost symmetrically located notches of each axis and an overall length L as measured between the centerline of the notch closest to one end of the element and the centerline of the notch closest to the other end of the element, said overall length L being equal to the total of all the sectional lengths Z wherein Z is substantially equal to (0 times x)p, wherein x is as defined, and p and 0 are independently whole numbers and wherein when L is a multiple of Z, p is the same as or different than the p value of an adjacent sectional length.

Another way of expressing the symmetry of the elements of the present invention and the preferred interrelationship of the segmental lengths thereof is to define that preferably the length of the element as measured segmentally between the centerline of each of the aligned end notches 34 and the centerline of the aligned additional notch 44 is substantially equal to $(2x)p_1+x$ and $(2x)p_2+x$ respectively, wherein $p_1$ and $p_2'$ are each the same or different whole numbers, and x is as defined.

Referring now to FIG. 4 there is illustrated another type of uniquely designed element 8 according to the present invention which element has two opposed side notches 38 cut into the length of said element 8 along its height wherein the height of said side notch 38 is substantially equal to x and the length of said notch is substantially equal to x and wherein said element is further provided with at least two additional deep notches 36,40 cut into the height of said element along its length wherein the height of said additional deep notches are 3x/2 the length of said notches is substantially equal to x and the length of the element as measured between the centerlines of two adjacent additional deep notches is substantially equal to 2x.

As shown with specific reference to FIG. 7 said elements 8 are especially designed to facilitate the creation of a rectangular opening 46 in a horizontal plane made of basic elements 202 or elements 6 as shown in FIG. 8. The elements 8 hooks between two long elements 202 or 6 (not at a notched point, but along its smooth width edge) said long elements having been located at an appropriate distance apart to receive said element 8. Finally, the neck of one or more shorter basic pieces 102 or 2 are inserted into the remaining notches of said element 8 as shown to complete one side of the rectangular opening 46.

Figure 5:
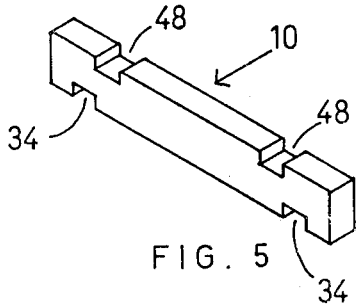
Figure 6:
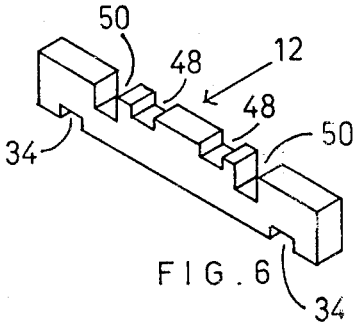

Referring now to FIGS. 5 and 6, there are shown two types of specialized elements 10, 12 according to the present invention which elements are especially adapted to facilitate the construction of integral stepped surfaces such as roofs and A frame walls in vertical building structures. Said elements each have a height of 2x, and are characterized by having two end notches 34 cut into the height of the element along the bottom side of its length and adjacent the respective ends of said elements, which notches have a length of x and a height of x/2, and two inset notches 48 cut into the height of the element along the top side of its length at a distance closer to each other than the distance between the end notches 34 which inset notches 48 also have a length of x and a height of x/2 and the length of the element as measured from the centerline of an end notch 34 to the centerline of the inset notch 48 closest to said end notch is substantially equal to x times q and wherein in the preferred embodiments shown q is 1 in element 10 and q is 3 in element 12.

While as shown in FIG. 5 pieces 10 are provided with only two end notches 34 and two inset notches 48 in element 12 as shown in FIG. 6 there are further provided two intermediate notches 50 cut into the height of the element along the top side of its length, each intermediate notch 50 being positioned adjacent the outer edge of an inset notch 48 wherein said intermediate notches 50 have a length of x and a height of x and wherein the length of the element as measured from the centerline of an intermediate notch to the centerline of its adjacent inset notch is 3x/2.

Figure 9:
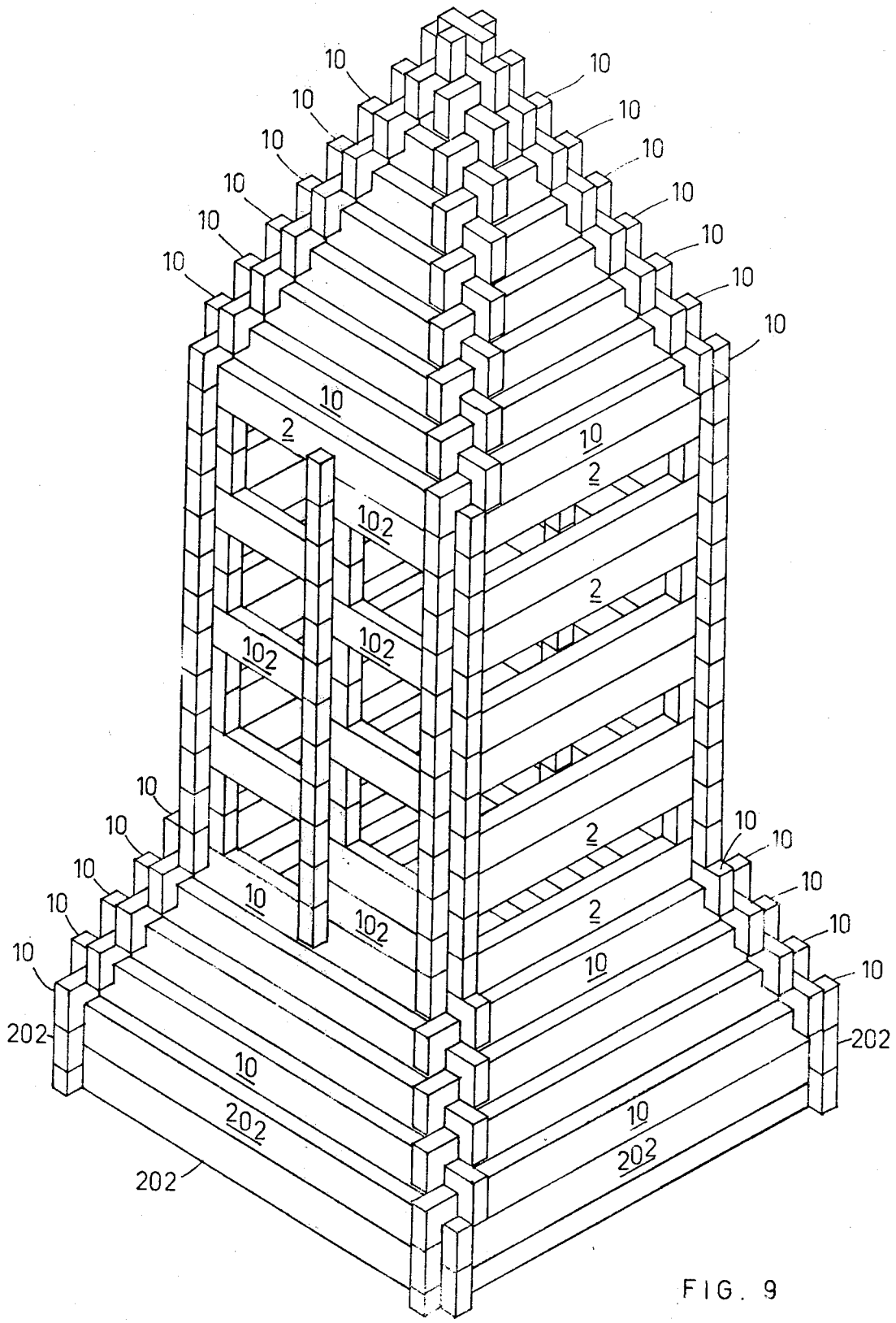

The function of said elements 10 and 12 as clearly shown with reference to FIGS. 8 and 9 is to facilitate the creation of sloped roof surfaces of varied pitch and/or to facilitate the building of pyramidal or A-frame walls. As shown with reference to FIG. 8 these elements 10 and/or 12 are provided in sets of pairs of decreasing length wherein said pieces are adapted for interengagement with basic elements 2 or 202 to form sloped roofs having two vertical planes and two sloped planes as shown whereby a fascimile of a gable roof or A-frame house is created. As can be seen the major difference between elements 10 and 12 is that elements 10 are adapted to interengage basic elements whose height are aligned vertically with the structure, which basic elements are connected to the notch 48 of one element 10 and the notch 34 of the element 10 thereabove with almost no space between the upper corner of one basic element and the adjacent lower corner of the basic element thereabove while roof element 12 is provided with intermediate notches 50 adapted to also interengage basic elements whose height are aligned horizontally with the structure thereby achieving a more gradual rate of ascent and smaller angle of pitch.

It is also interesting to note that when four sets of elements 10 are combined perpendicularly or when four sets of elements 12 (with fillers of some basic elements as needed) are so combined, the result is four sloping plane-like areas which create the facsimile of a hip roof or pyramid shape as shown with elements 10 in FIG. 9.

As will be realized the building elements of the present invention can be made of any suitable material such as hard wood or plastic and can be used with other auxiliary elements, not forming part of the present invention, to achieve some of the effects illustrated in FIGS. 8 and 9.

If hard wood pieces are used it is preferable to color different types of pieces with different colors to help children easily recognize and find the type of piece they are looking for, e.g., basic element 2, 102, 202 or roof or stepped wall elements 10 and 12.

Similarly, if the elements are made of plastic it is economically preferable to make them of hollow plastic of different colors wherein at least one of the types of elements, e.g., either wall elements or roof elements are made of transparent plastic to enable the inner details of a completed building or structure to be viewed.

It will be evident to those skilled in the art that the invention is not limited to the details of the foregoing illustrative embodiments and that the present invention may be embodied in other specific forms without departing from the spirit or essential attributes thereof, and it is therefore desired that the present embodiments be considered in all respects as illustrative and not restrictive, reference being made to the appended claims, rather than to the foregoing description, in which it is intended to claim all modifications coming within the scope and spirit of the invention.

What is claimed is:

1. A toy building set especially adapted to facilitate the construction of integral plan horizontal and stepped surfaces in vertical building structures comprising:

a plurality of rectangularly-shaped prismatic elements having a height, a length and a width dimension and each having a rectangular cross-section along at least a portion of their length;

the height of each said elements being twice their width;

at least two notches cut into said elements in the direction of the height of the element and spaced from each other along the axis in the direction of the axial length of each said prismatic elements;

said two notches being positioned adjacent the respective ends of each said element; and, each said notch having a length along the length dimension of said element substantially equal to the width and height with dimension of half said width multiplied by a multiplier wherein with regard to each individual element said multiplier is the same and equal to 1 or 3 wherein the length of said elements, as measured between the centerlines of said at least two notches is a factor multiplied by the width dimension substantially equal to the factor wherein the width dimension is the whole number or fraction thereof and the factor is a whole number.

2. A toy set comprising a plurality of building elements according to claim 1 which elements each comprise at least two-end-notches cut into the height of the element along its length and adjacent the respective ends of said element wherein said notches each has a height one-half said width dimension and wherein the length of the elements as measured between the centerlines of said end notches is substantially equal to the sum of an even whole integer multiplied by said width dimension and said factor plus said width dimension.

3. Building elements for a toy building set according to claim 2 which elements each contain at least one further notch cut into the height of said element along its length, wherein said element has a sectional length as measured between the centerline of a pair of outermost symmetrically located notches of each axis and an overall length along said axis as measured between the centerline of the notch closest to one end of the element and the centerline of the notch closest to the other end of the element, said overall length being equal to the total of all the sectional lengths wherein said sectional length is substantially equal to said even whole integer multiplied by said width dimension and wherein when said overall length is a multiple of said sectional length, said factor is the same as or different from the factor value of an adjacent sectional length.

4. Building elements for a toy building set according to claim 2 which elements each comprise two sets of opposed end notches cut into the height of said element along its length and adjacent the respective ends of said element wherein said notches each has a height of half said width dimension and wherein the neck of one element formed between sets of opposed end notches is adapted to engage a notch of another element both with the height of said neck spanning the length of the notch of said other element and with the width of said neck spanning the length of the notch of said other element.

5. Building elements as claimed in claim 4 which elements each comprise at least one intermediate notch cut into the height of said element along its length and positioned between a pair of end notches which intermediate notch is characterized by a height, length and width all substantially equal to said width dimension and wherein the length of the element as measured between the inner walls of said end notches is twice said width dimension multiplied by said factor wherein said width dimension is as defined and said factor is any whole number.

6. Building elements for a toy building set as claimed in claim 2 which elements each have two sets of opposed end notches cut into the height of said element along its length and adjacent the respective ends of said element and at least one pair of opposed additional notches cut into the height of said element along its length wherein all of said notches have a height of one-half of said width dimension and wherein in the length of the element as measured between the center lines of two aligned end notches is substantially equal to the sum of twice said height multiplied by said factor plus the sum of a quantity and one, said quantity and one being multiplied by said width dimension wherein said quantity is the number of pairs of opposed additional notches.

7. A building element according to claim 6 wherein the length of the element as measured segmentally between the centerline of each of the aligned end notches and the centerline of an aligned additional notch is substantially equal to the sum of twice said width dimension multiplied by a first whole number plus width dimension and the sum of twice said width dimension multiplied by a second whole number plus said width dimension.

8. Building elements for a building set according to claim 1 which elements each have two opposed side notches cut into the length of said element along its height wherein the height of each of said side notches is substantially equal to said width dimension and the length of said notch is substantially equal to said width dimension and wherein said element is further provided with at least two additional deep notches cut into the height of said element along its length wherein the height of said additional deep notches are one and one-half times said width dimension, the length of said notches is substantially equal to said width dimension and the length of the element is as defined.

9. Building elements for a toy building set as claimed in claim 1 which elements each have a height of twice said width dimension, and are characterized by having two end notches cut into the height of the element along the bottom side of its length and adjacent the respective ends of said element, which notches have a length equal to said width dimension and a height of one-half said width dimension, and two inset notches cut into the height of the element along the top side of its length at a distance closer to each other than the distance between the end notches which inset notches also have a length equal to said width dimension and a height of one-half said width dimension and wherein the length of the element as measured from the centerline of an end notch to the centerline of the inset notch closest to said end notch is substantially equal to said width dimension multiplied by an odd integer.

10. Building elements for a toy building set as claimed in claim 9 wherein said odd integer is 1.

11. Building elements for a toy building set as claimed in claim 10 wherein said odd integer is 3, and wherein there are further provided two intermediate notches cut into the height of the element along the top side of its length, each intermediate notch being positioned adjacent the outer edge of an inset notch wherein said intermediate notches have a length equal to said width dimension and a height equal to said width dimension and wherein the length of the element as measured from the centerline of an intermediate notch to the centerline of its adjacent inset notch is one and one-half times said width dimension.

* * * * *